United States Patent [19]

Rinehart

[11] 4,322,309

[45] Mar. 30, 1982

[54] COMPOSITION CAPABLE OF REMOVING HYDROPHILIC AND HYDROPHOBIC CONTAMINANTS FROM SURFACES

[75] Inventor: William M. Rinehart, Centralia, Mo.

[73] Assignee: A. B. Chance Company, Centralia, Mo.

[21] Appl. No.: 224,792

[22] Filed: Jan. 13, 1981

Related U.S. Application Data

[63] Continuation of Ser. No. 34,195, Apr. 27, 1979, abandoned.

[51] Int. Cl.[3] ..... C11D 3/44; C11D 7/50

[52] U.S. Cl. ..... 252/171; 252/162; 252/170; 252/364

[58] Field of Search ..... 252/161, 170, 171, DIG. 9, 252/364; 138/31, 38, 40, 42

[56] References Cited

U.S. PATENT DOCUMENTS

| | | | |
|---|---|---|---|
| 2,371,644 | 3/1945 | Petering et al. . | |
| 3,546,304 | 12/1970 | Patron | 260/652.5 |
| 3,574,123 | 4/1971 | Laugle | 252/144 |
| 3,592,691 | 7/1971 | Stelter | 134/42 |
| 3,625,763 | 12/1971 | Melilo | 134/38 |
| 3,743,542 | 7/1973 | Cooper et al. | 134/31 |
| 3,789,005 | 1/1974 | McMillan et al. | 252/171 |
| 3,789,007 | 1/1974 | Robinson | 252/171 |
| 4,023,984 | 5/1977 | Clementson et al. | 134/38 |
| 4,056,403 | 11/1977 | Cramer et al. | 134/22 R |

FOREIGN PATENT DOCUMENTS

| | | |
|---|---|---|
| 2215731 | 12/1972 | Fed. Rep. of Germany . |
| 794304 | 2/1936 | France . |
| 1165709 | 4/1960 | France . |
| 45-4847 | 2/1970 | Japan . |
| 45-12488 | 5/1970 | Japan . |
| 566815 | 7/1977 | U.S.S.R. . |

*Primary Examiner*—P. E. Willis, Jr.

*Attorney, Agent, or Firm*—Schmidt, Johnson, Hovey & Williams

[57] ABSTRACT

A novel cleaning and drying composition is disclosed which has a number of unique properties rendering the composition particularly useful for cleaning and refinishing electrical equipment and tools. The composition preferably comprises about 30% ethanol, 50% methylene chloride, 15% 1,1,1-trichloroethane and 5% perchloroethylene; this combination of ingredients gives a final product that dissolves water and many organic materials while at the same time having a high evaporation rate and flame resistance (flash point greater than 100° F.). The composition also gives a visual indication of the need for recleaning and replacement thereof by becoming cloudy when excessive moisture has been absorbed.

1 Claim, No Drawings

COMPOSITION CAPABLE OF REMOVING HYDROPHILIC AND HYDROPHOBIC CONTAMINANTS FROM SURFACES

This is a continuation, of application Ser. No. 34,195 filed on Apr. 27, 1979, now abandoned.

BACKGROUND OF THE INVENTION

1. Field of the Invention

The present invention is concerned with novel compositions which are capable of removing both hydrophilic and hydrophobic contaminants from surfaces. More particularly, it is concerned with compositions which are especially suited for cleaning and refinishing electrical equipment and tools, and to this end the compositions have a number of unique properties. Principal among these properties are the ability to dissolve water and organic materials, coupled with high evaporation rates and resistance to flaming.

2. Description of the Prior Art

Equipment and tools used by electrical utilities often become contaminated with a large variety of materials such as grease, dirt, salt and water. Such equipment and tools thus need to be cleaned and refinished periodically, in order to maintain safe operating conditions. Popular cleaners heretofore used for this purpose have generally included chlorinated solvents such as perchloroethylene and trichloroethane. These solvents do not, however, remove water or wet contamination that may be tightly held on the surface of a well-used tool. Removal of such water is important not only to maximize the electrical integrity of the tool, but also to ensure a good bond when the tool is recoated.

There are of course solvents that can readily remove water, such as alcohol or acetone. These solvents are highly flammable however, having flash points well below 100° F., and thereby present a danger during use. Heretofore known solvents which dissolve water and have flash points greater than 100° F. evaporate far too slowly for practical use as a cleaner-dryer.

Prior patents describing various types of cleaning compositions include: U.S. Pat. Nos. 3,592,691, 3,625,763, 3,743,542, 3,546,304, 3,574,123, 3,789,007 and 4,023,984.

SUMMARY OF THE INVENTION

Greatly improved cleaning and drying compositions which overcome the problems noted above have now been discovered. Broadly speaking, the compositions comprise, wherein all percentages are by weight, based upon the total weight of the composition taken as 100%, a basic mixture having therein from about 25 to 35% ethanol and from about 40 to 70% of a compound selected from the group consisting of methylene chloride, Freon 11 and mixtures thereof. In addition, from about 0 to 35% of an adjunct admixed with the basic mixture can be included which has one or more chlorinated hydrocarbons therein. The adjunct should be such as to not substantially lower the flame resistance of the basic mixture, however.

In more preferred forms, the ethanol should be present at a level of about 30% and the adjunct should include 1,1,1-trichloroethane and perchloroethylene, in order to increase the solvent properties of the overall composition.

Compositions in accordance with the invention have flash points of greater than 100° F., can remove water and various other materials such as organic contaminants, and give a visual indication of when the composition should be replaced. This unique combination of properties has heretofore not been available in any known composition.

DESCRIPTION OF THE PREFERRED EMBODIMENTS

The compositions of the present invention are in liquid form and are particularly adapted for cleaning and drying surfaces such as those on electrical equipment and tools. The compositions are capable of removing both hydrophilic and hydrophobic contaminants from surfaces, and have a variety of desirable properties. The basic mixture of the compositions of the invention have therein from about 25 to 35% ethanol and from about 40 to 70% of a compound selected from the group consisting of methylene chloride, Freon 11 and mixtures thereof. From about 0 to 35% of an adjunct can be admixed with the basic mixture and includes one or more chlorinated hydrocarbons; the adjuncts should be such as to not substantially lower the flame resistance of the basic mixture (i.e., flash point should be higher than about 100° F.) and should not evaporate at an excessively slow rate (the rate should be less than about 2, with the evaporation rate of butyl acetate taken as 1). Throughout the instant specification and claims, all percentages are given on a weight basis, based upon the total weight of the composition taken as 100%.

The ethanol component of the compositions of the invention is most preferably present at a level of about 30%. The function of the alcohol is believed to be as a dryer and water remover. Below about 25%, the overall compositions have been found to be inefficient at removing water; on the other hand, above about 35% ethanol, the flame resistance of the compositions is excessively lowered. Therefore, a certain degree of criticality exists with respect to the use of ethanol, and the percentages of use.

It will also be understood that denatured ethyl alcohol has actually been used in the invention. The denaturant in the alcohol is a combination of methyl isobutyl ketone and heptane, and the alcohol is 95% ethanol and 5% denaturant. Although the specific chemical identity of the denaturant is not critical, it is preferred that the denaturants have relatively rapid evaporation rates, i.e., greater than about 1.5, with n-butyl acetate being taken as 1. For example, kerosene or gasoline as denaturants would not evaporate with sufficient rapidity and should not be used for this purpose. Of course, pure ethanol could also be used in the invention if available.

The other component of the basic mixture is selected from the group consisting of methylene chloride and Freon 11 and mixtures thereof. This component serves as a vapor phase flame retardant for the ethanol, and in effect raises the flash point of the latter. Here again, the amount of this component used in the basic mixture is of some importance in order to obtain adequate flame protection. Methylene chloride is the preferred component and not only functions as a flame retardant because of its high relative evaporation rate but because it itself is not flammable. Freon 11 has these properties as well, but methylene chloride is nevertheless preferred because of its higher boiling point. The most preferred level of use of methylene chloride is about 50%.

The adjunct can be used at a level of from about 0 to 35%, most preferably about 20%. The adjunct includes a chlorinated hydrocarbon selected from the group consisting of 1,1,1-trichloroethane, perchloroethylene, 1,1,2-trichloroethane and propylene dichloride. In particularly preferred forms, the adjunct consists essentially of about 15% 1,1,1-trichloroethane and about 5% perchloroethylene. The adjunct serves to add variety of chemical types to the compositions so that they will be solvent for a greater variety of materials. Furthermore, the evaporation rates of the particular chlorinated hydrocarbons listed are closer to that of the preferred ethyl alcohol. These features increase the quality of the cleaner, but do not necessarily add to the properties of water solubility, rapid evaporation and flame retardancy. This unusual combination of properties can be obtained in a composition which includes only ethanol and methylene chloride (preferably 30% alcohol, 70% methylene chloride).

The chlorinated hydrocarbons used in the adjunct should all be of a so-called vapor degreasing grade, in order that catalytic decomposition does not occur during storage of the composition. However, this is not an absolute essential to the invention.

In preparative procedures, the selected ingredients are simply admixed at ambient temperatures to yield the final composition. No special steps or mixing procedures are required.

The most preferred composition of the invention as described above has a flash point of about 116° F., and a water solvency (ml.$H_2O$ per 100 grams of composition) of 4.5; however, if the composition is slightly altered, e.g., to 40% methylene chloride, 20% ethyl alcohol, 30% 1,1,1-trichloroethane and 10% perchloroethylene, the flash point drops to 82° F., and the water solvency power is reduced by more than half, to 2.2.

The compositions of the invention exhibit a number of unique properties in combination. As noted above, the compositions dissolve water and a wide variety of other contaminants; the flame resistance of the compositions is high (flash point of greater than about 100° F.); the compositions evaporate rapidly; and the compositions give a visual indication of the need for recleaning and recoating by becoming cloudy upon absorption of sufficient amounts of moisture. This combination of properties is highly advantageous and novel.

Having thus described the invention, what is claimed as new and desired to be secured by Letters Patent is:

1. A cleaning and drying composition consisting essentially of, wherein all percentages are by weight, based upon the total weight of the composition taken as 100%:

about 30% ethanol;

about 50% of a compound selected from the group consisting of methylene chloride, trichlorofluoromethane and mixtures thereof; and about 20% of additional material, comprising a chlorinated hydrocarbon selected from the group consisting of 1,1,1-trichloroethane, perchloroethylene, 1,1,2-trichloroethane, propylene dichloride and mixtures thereof.

said composition having a flash point of greater than about 100° F., the ability to absorb moisture and dissolve a variety of organic materials, and the property of becoming cloudy when excessive moisture has been absorbed thereby.

* * * * *